United States Patent [19]

Yanagishita et al.

[11] Patent Number: 4,757,874

[45] Date of Patent: Jul. 19, 1988

[54] AIR INTAKE NOISE SUPPRESSOR FOR AN INTERNAL COMBUSTION ENGINE

[75] Inventors: Masami Yanagishita, Asaka; Shoichi Nemoto, Saitama, both of Japan

[73] Assignee: Honda Giken Kogyo Kabushiki Kaisha, Tokyo, Japan

[21] Appl. No.: 70,404

[22] Filed: Jul. 7, 1987

[30] Foreign Application Priority Data

Jul. 17, 1986 [JP] Japan ..... 61-108676[U]

[51] Int. Cl.[4] ..... F02M 35/00

[52] U.S. Cl. ..... 181/229; 181/227; 181/250

[58] Field of Search ..... 181/227, 229, 250

[56] References Cited

U.S. PATENT DOCUMENTS

| | | | |
|---|---|---|---|
| 2,323,955 | 7/1943 | Wilson | 181/229 |
| 3,396,812 | 8/1968 | Wilcox et al. | 181/250 |
| 4,109,751 | 8/1978 | Kabele | 181/229 X |
| 4,418,443 | 12/1983 | Fischer | 181/250 X |
| 4,546,733 | 10/1985 | Fukami et al. | 181/229 X |
| 4,562,800 | 1/1986 | Tsujibayashi | 181/229 X |

*Primary Examiner*—B. R. Fuller
*Attorney, Agent, or Firm*—Lyon & Lyon

[57] ABSTRACT

An air intake noise suppressor for reducing noise generated by intake air sucked into an internal combustion engine. An intake pipe is provided with a resonance pipe, which extends forwards within the intake pipe as penetrating through a rear end wall of the intake pipe, communicates with the interior of the intake pipe through an opening at its front end, extends backwards from the rear end wall externally of the intake pipe and has its rear end closed, and the resonance pipe is fixedly locked to the intake pipe at its portion penetrating through the rear end wall and in the proximity of the opening at the front end. Since the resonance pipe is accommodated within the intake pipe over a considerable length and only its rear end portion projects backwards from the intake pipe, a surplus space is almost not necessitated for mounting the resonance pipe, and yet the resonance pipe itself can be made sufficiently long. The resonance pipe is supported simply and rigidly at its front end portion and at its middle portion by the intake pipe, and other support members are not necessitated.

4 Claims, 2 Drawing Sheets

AIR INTAKE NOISE SUPPRESSOR FOR AN INTERNAL COMBUSTION ENGINE

BACKGROUND OF THE INVENTION

The present invention relates to an air intake noise suppressor for reducing noise generated by intake air sucked into an internal combustion engine such as, for example, an internal combustion engine for use in a vehicle.

As one of such air intake noise supporessors, there is known an air intake noise supporessor in which a branch pipe (a resonance pipe) having its tip end closed is branched from a midway of an intake air passageway so that air intake noise in a particular frequency region can be attenuated by the air within that branch pipe being resonant with oscillation of intake air flowing through the intake air passageway, and such an air intake noise suppressor is disclosed, for example, in Japanese Laid-Open Utility Model Publication No. 58-53846 (1983).

In this air intake noise supporessor, the branch pipe branched from an intake pipe extends externally nearly at right angles to the intake pipe, and the tip end of the branch pipe is inserted into an exhaust pipe.

However, in the above-described air intake noise suppressor in the prior art, since the whole length of the branch pipe projects laterally from the intake pipe, and moreover, since the length of the branch pipe is determined by the intended resonance frequency and cannot be shortened arbitrarily, sometimes difficult problems were encountered with respect to a place for mounting a branch pipe and a method for supporting the same, especially in the case of an internal combustion engine for use in a vehicle such as a motorcycle or the like in which a place for mounting the air intake noise suppressor is limited.

SUMMARY OF THE INVENTION

According to the present invention, in an air intake noise suppressor constituted by branching a resonance pipe having its tip end closed from an intake pipe of an internal combustion engine, the intake pipe is provided with a resonance pipe, which extends forwards within the intake pipe as penetrating through a rear end wall of the intake pipe, communicates with the interior of the intake pipe through an opening at its front end, extends backwards from the rear end wall of the intake pipe externally of the intake pipe and has its rear end closed, and the resonance pipe is fixedly locked to the intake pipe at its portion penetrating through the rear end wall and in the proximity of the opening at its front end.

According to the present invention, since the resonance pipe is accommodated within the intake pipe over a considerable length with only its rear portion projecting backwards from the intake pipe, a surplus space is almost not necessitated for mounting the resonance pipe, and yet the resonance pipe itself can be made sufficiently long. Moreover, this resonance pipe can be supported simply and rigidly at its front end portion and at its middle portion by the intake pipe, and other support members are not necessitated.

DETAILED DESCRIPTION OF THE PREFERRED EMBODIMENT

Figure 1:
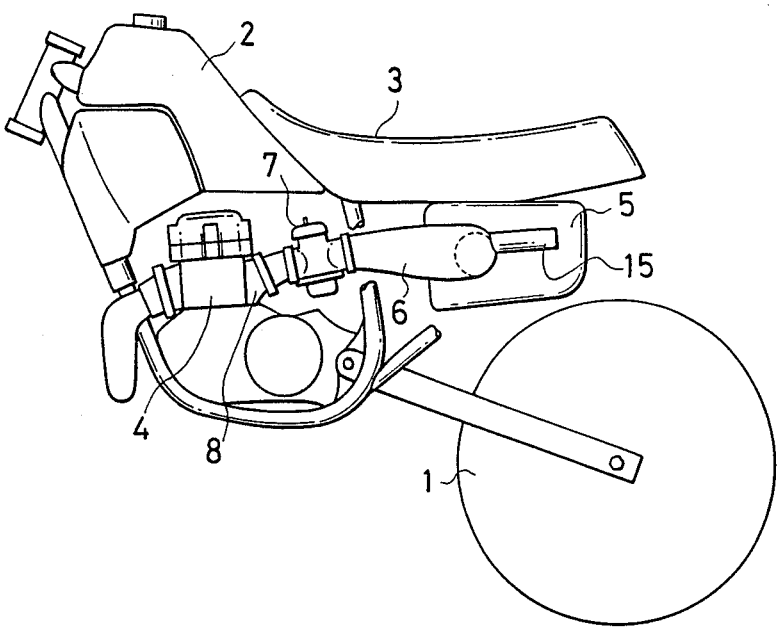
FIG. 1 is a side view showing a part of a motorcycle to which the present invention is applied.
Figure 2:
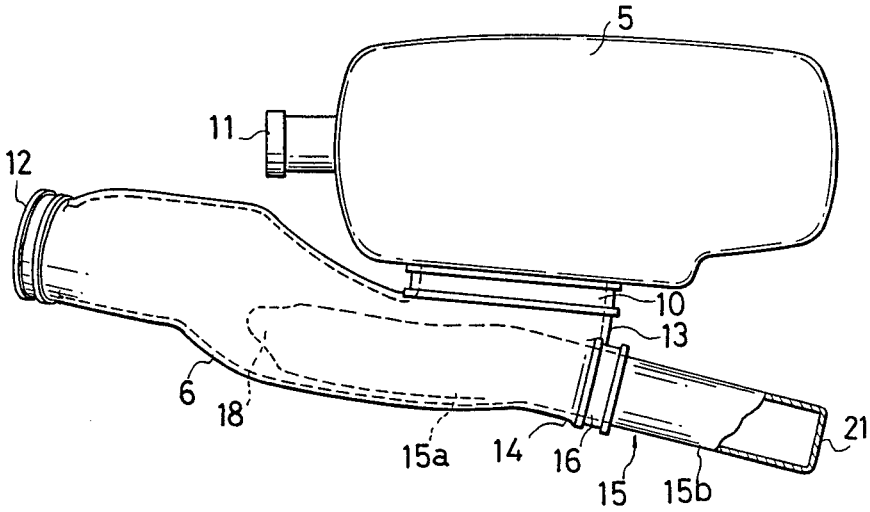
FIG. 2 is an enlarged plan view of an intake pipe portion of the same motorcycle.
Figure 3:
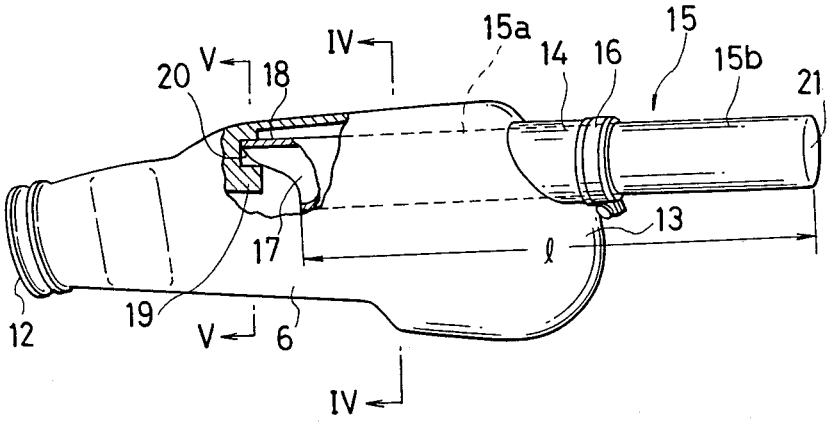
FIG. 3 is a side view of the same.
Figure 4:
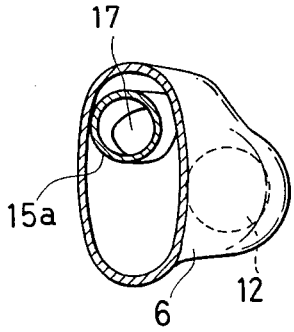
FIGS. 4 and 5 are cross-sectional views taken along line IV—IV and line V—V, respectively, in FIG. 3.
Figure 5:
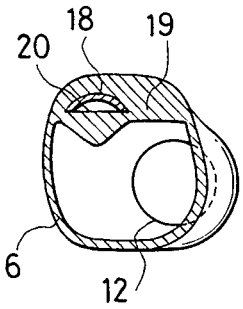

A part of a motorcycle to which the present invention is applied, is shown in FIG. 1 wherein reference numeral 1 designates a rear wheel, numeral 2 designates a fuel tank, and numeral 3 designates a seat. An internal combustion engine 4 is mounted in front of the rear wheel 1 and under the fuel tank 2. Intake air for the engine 4 is sucked through an air cleaner 5 disposed under the seat 3, an intake pipe 6 and a carburettor 7 to an intake port 8. A resonance pipe 15 projects backwards from a rear end portion of the intake pipe 6.

Now details of the intake pipe 6 and the resonance pipe 15 will be explained with reference to FIGS. 2 to 5. The intake pipe 6 communicates with the interior of the air cleaner 5 via an inlet 10 opening sideways, and air flowing into the air cleaner 5 through an air intake 11 provided on the front surface of the air cleaner 5 is cleaned and thereafter enters into the intake pipe 6 through the inlet 10. The intake pipe 6 bends at the portion of the inlet 10 and extends forwards, and an outlet 12 at the front end is connected to the above-mentioned carburettor 7. At the rear end wall 13 of the intake pipe 6 is integrally formed a cylindrical reception member 14, and the resonance pipe 15 is inserted into the intake pipe from the rear as penetrating through that reception member 14 in a tightly fitted condition. An end portion of the reception member 14 is in a state split into two, and by fastening this split portion externally by means of a band 16 the resonance pipe 15 is fixedly secured to the intake pipe 6.

A front portion **15*a* of the resonance pipe 15 inserted into the intake pipe 6 extends forwards along the intake pipe 6 and commmunicates with the interior of the intake pipe 6 through an opening 17 at its front end. At the front end of the resonance pipe 15, a claw-like locking piece 18 projecting further forwards than the opening 17 is formed by cutting the tube wall obliquely. On the other hand, on the inner wall surface of the intake pipe 6 is formed a locking portion 19, and by inserting the above-described locking piece 18 into a locking hole 20 provided in the locking portion 19, the front end portion of the resonance pipe 15 is fixedly locked to the intake pipe 6**.

A rear portion **15*b* of the resonance pipe 15 projects externally from the above-mentioned reception member 14 and extends backwards, and the rear end of the rear portion 15*b* is closed by an end plate 21**.

The whole length l of the resonance pipe 15 is chosen such that a resonance frequency of the resonance pipe 15 may match with a frequency characteristic of air intake noise propagating through the intake pipe 6. Accordingly, the air intake noise has its energy absorbed by the air within the resonance pipe 15 being resonant with the noise, and is thus attennated. However, since the front portion **15*a* which occupies a considerable proportion with respect to the whole length l of the resonance pipe 15 that is necessitated for the resonance, is present within the intake pipe 6, and since only the rear portion 15*b* which is relatively short projects backwards from the intake pipe 6, the place for mounting the intake pipe would never be restricted for the purpose of avoiding interference with other component parts. In addition, since the resonance pipe 15 has its front end supported by the locking hole 20 via the locking piece 18 and has its middle portion supported by the reception member 14 at the rear end wall 13, special supporting means is not necessitated, and mounting to the intake pipe 6** is also extremely easy.

While the present invention has been described above in connection to one preferred embodiment as applied to an internal combustion engine for use in a motor cycle, it is a matter of course that the invention should not be limited to the above-described embodiment but it is applicable to other internal combustion engines. accordingly, the terms of "front (forwards)" and "rear (backwards)" of an intake pipe and a resonance pipe as used in the appended claims do not always means "front" and "rear" of a motorcycle, but the downstream side with respect to a flow of intake air within an intake pipe should be understood to be "front (forwards)" and the upstream side should be understood to be "rear (backwards)".

What is claimed is:

1. An air intake noise suppressor formed by branching a resonance pipe having a rear tip end closed from an intake pipe of an internal combustion engine; characterized in that the intake pipe is provided with said resonance pipe, which extends forwardly within said intake pipe by penetrating through a rear end wall of the intake pipe, said resonance pipe communicates with the interior of said intake pipe through an opening at a front end, extends backwards from said rear end wall externally of said intake pipe towards said closed rear end, and said resonance pipe is fixedly locked to said intake pipe at a portion penetrating through said rear end wall and in the proximity of the opening at said front end.

2. An air intake noise suppressor as claimed in claim 1, wherein said intake pipe projects from a side of an air cleaner and is bent forwardly providing a bending portion and said rear end wall is formed in said bending portion.

3. An air intake noise suppressor as claimed in claim 1, wherein a forwardly projecting claw-like locking piece is formed at the front end of said resonance pipe by obliquely cutting a wall of said resonance pipe, and a locking hole for locking the resonance pipe by inserting said locking piece into the locking hole formed in an inner wall of said intake pipe.

4. An air intake noise suppressor as claimed in claim 1, wherein a split reception member is provided on the rear end wall of said intake pipe, and the resonance pipe is fixed to the intake pipe by fastening said reception member externally by means of a band.

* * * * *